US011619075B2

(12) United States Patent
Grzonka

(10) Patent No.: US 11,619,075 B2
(45) Date of Patent: Apr. 4, 2023

(54) MOTOR VEHICLE DOOR LOCK

(71) Applicant: Kiekert AG, Heiligenhaus (DE)

(72) Inventor: Andrzej Grzonka, Witten (DE)

(73) Assignee: Kiekert AG, Heiligenhaus (DE)

( * ) Notice: Subject to any disclaimer, the term of this patent is extended or adjusted under 35 U.S.C. 154(b) by 185 days.

(21) Appl. No.: 16/641,839

(22) PCT Filed: Sep. 6, 2018

(86) PCT No.: PCT/DE2018/100759
§ 371 (c)(1),
(2) Date: Feb. 25, 2020

(87) PCT Pub. No.: WO2019/048006
PCT Pub. Date: Mar. 14, 2019

(65) Prior Publication Data

US 2021/0164268 A1 Jun. 3, 2021

(30) Foreign Application Priority Data

Sep. 6, 2017 (DE) ..... 10 2017 120 453.9

(51) Int. Cl.
*E05B 15/04* (2006.01)
*E05B 77/36* (2014.01)

(52) U.S. Cl.
CPC ..... *E05B 77/36* (2013.01); *E05B 15/04* (2013.01); *E05B 2015/0403* (2013.01); *E05B 2015/0486* (2013.01)

(58) Field of Classification Search
CPC ..... E05B 77/36; E05B 77/42; E05B 85/20; E05B 85/24; E05B 85/243; E05B 85/26; E05B 15/04; E05B 2015/0403; E05B 2015/041; E05B 2015/0486; E05B 2015/0496; Y10T 292/1047; Y10T 292/1082; Y10S 292/23
See application file for complete search history.

(56) References Cited

U.S. PATENT DOCUMENTS 9,752,357 B2 9/2017 Scholz
10,132,109 B2 * 11/2018 Bendel ..... E05B 85/26
(Continued)

FOREIGN PATENT DOCUMENTS

CN 104411906 A 3/2015
DE 202007013330 U1 2/2009
(Continued)

OTHER PUBLICATIONS

Translation of First Office Action dated Jan. 28, 2021, for related Chinese Patent Application No. 201880057648.9.
(Continued)

*Primary Examiner* — Christine M Mills
*Assistant Examiner* — Peter H Watson
(74) *Attorney, Agent, or Firm* — Renner, Otto, Boisselle & Sklar, LLP

(57) ABSTRACT

A motor vehicle door lock which is equipped with a locking mechanism that consists essentially of a rotary latch and a pawl. The lock also comprises a pawl spring for action on the pawl in the closing direction. The motor vehicle door lock further comprises an actuating lever for opening the locking mechanism. The actuating lever is additionally designed to act upon the pawl spring.

13 Claims, 1 Drawing Sheet

(56) References Cited

U.S. PATENT DOCUMENTS

| | | | | |
|---|---|---|---|---|
| 2004/0144142 | A1* | 7/2004 | Dimig | E05B 79/20 70/237 |
| 2011/0012376 | A1* | 1/2011 | Hunt | E05B 85/26 292/216 |
| 2012/0068480 | A1* | 3/2012 | Bendel | E05B 85/26 292/195 |
| 2015/0084351 | A1* | 3/2015 | Scholz | E05B 85/00 292/200 |
| 2015/0097379 | A1* | 4/2015 | Spurr | E05B 85/26 292/200 |

FOREIGN PATENT DOCUMENTS

| | | | | |
|---|---|---|---|---|
| DE | 102008039240 | A1 | 2/2010 | |
| DE | 102012102724 | A1 | 10/2013 | |
| DE | 102012107981 | A1 | 5/2014 | |
| DE | 102018126163 | A1 * | 4/2020 | E05B 85/26 |
| EP | 1820926 | A2 * | 8/2007 | E05B 17/0037 |
| EP | 2860335 | A2 | 4/2015 | |

OTHER PUBLICATIONS

International Search Report issued on related PCT application PCT/DE2018/100759.

* cited by examiner

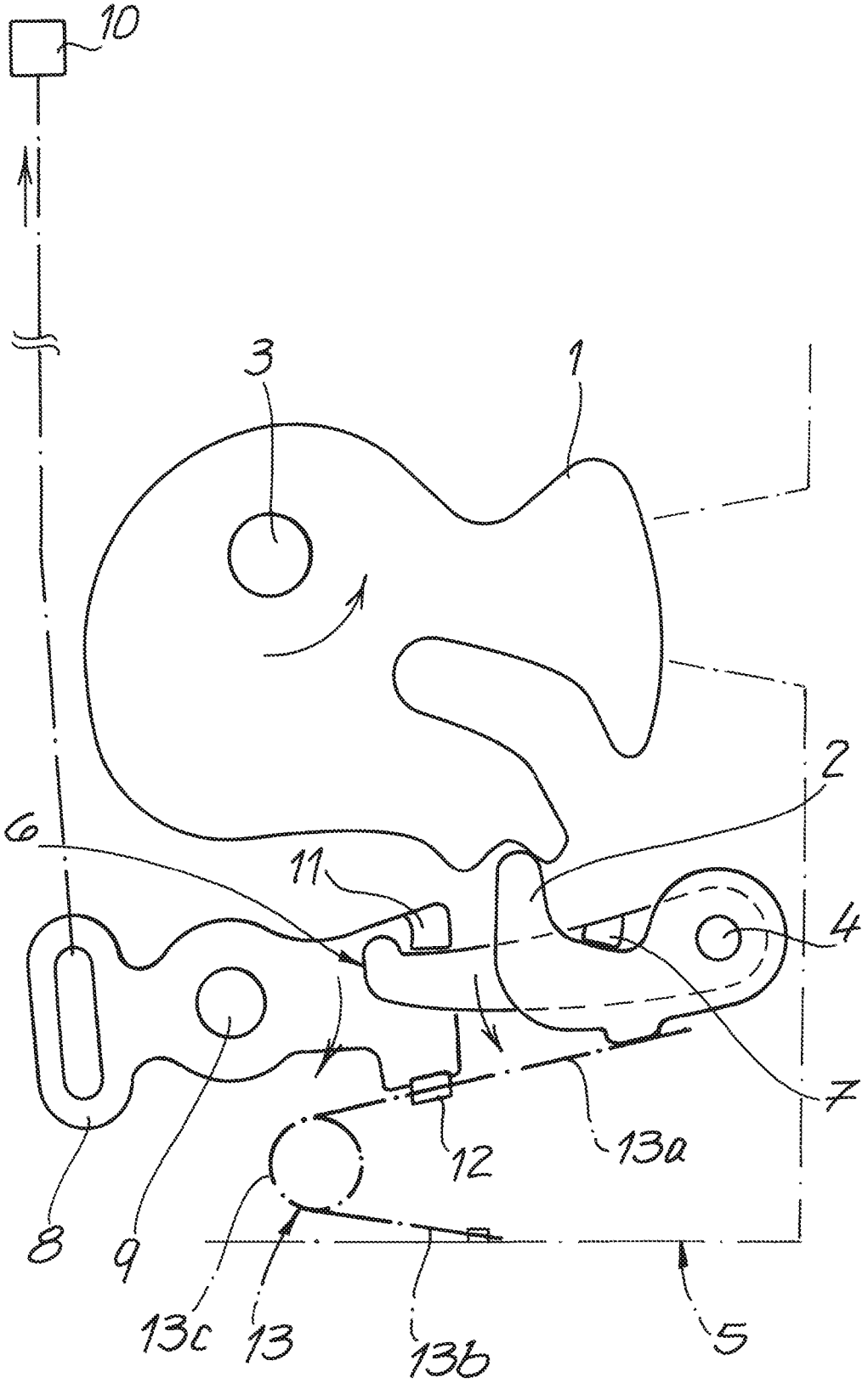
10
3
1
2
6
11
4
7
12
13a
8
9
13c
13
13b
5

MOTOR VEHICLE DOOR LOCK

FIELD OF DISCLOSURE;

The invention relates to a motor vehicle door latch comprising a locking mechanism consisting substantially of a catch and pawl, further comprising a pawl spring for acting on the pawl in the closing direction, and comprising an actuation lever for opening the locking mechanism.

BACKGROUND OF DISCLOSURE;

A motor vehicle door latch of the design described at the outset is explained in detail for example in DE 10 2008 039 240 A1 by the applicant. At this point, what is known as a two-latch locking mechanism is achieved. A tripping lever interacts, during the movement thereof, with a carrier pin of the first pawl. In this case, the lateral pawl spring forms an abutment between the carrier pin and the tripping lever, during the interaction. For this purpose, the pawl spring is accommodated in a receptacle of the first pawl. Then, in addition a further second pawl is formed in addition to the first pawl, which second pawl essentially ensures that the first pawl is secured.

In general, in the case of motor vehicle latches, the catch and optionally the pawl are in each case pre-loaded by means of an associated spring, the catch spring and the pawl spring, respectively, in such a way that both the catch and the pawl are reliably returned to the basic position thereof. In particular, the pawl spring for acting on the pawl causes the pawl to be acted upon in the closing direction. The closing direction of the pawl corresponds thereto, such that it can block the catch.

In contrast, the catch spring typically works on the catch in such a way that said catch is moved into the open position thereof when it is released from the pawl. In general a tripping lever is used for this, which lever raises the pawl from its engagement with the catch. The tripping lever is, in turn, generally acted upon by the actuation lever for opening the locking mechanism. It is also possible for the tripping lever and the actuation lever to coincide or to form and define a continuously integral lever.

In this case, the actuation lever can be acted on manually, overall, in order to open the locking mechanism, and in this connection the tripping lever can be pivoted such that it raises the pawl from the engagement thereof in the catch. In principle, however, the actuation lever can also be activated in an electromotive manner, as is the case in what is known as "electric opening" or in general in an electric lock. In this case, the actuation lever again ensures, via the tripping lever, that the pawl is raised from the catch, so that the catch can subsequently open in a spring-loaded manner. A previously caught locking bolt is released. The same applies for the motor vehicle door or motor vehicle hatch that is equipped with the motor vehicle door latch in question.

The state of the art is essentially proven and tested. However, in the case of a slow opening process of the locking mechanism, i.e. slow raising of the pawl from the catch, in practice what is known as a "double clack" is often observed as noise. A "double clack" of this kind is due to the pawl being raised from the catch or an associated main ratchet recess, and creating a first clack sound.

If, in this context, the associated motor vehicle is opened quickly, for example as a result of a high opening pressure built up by peripheral rubber door seals, in the pawl spring that acts on the pawl in the closing direction can ensure, inter alia, that the pawl is moved back and creates an additional smashing noise, for example when striking a pre-ratchet recess of the catch. That is to say, in this case the pawl has not been raised quickly enough from the catch and the pawl spring additionally causes said double clack noise.

Since motor vehicle door latches are typically fastened inside a door wing or a hatch, the interior acting as a resonating body for such noises and in addition extra noise transfer, in the form of impact sound on the motor vehicle body, taking place, such noises are considered unnatural, and therefore disturbing, by a possible user. At most a single clack noise is accepted, in the case of a reliably and correctly functioning motor vehicle door latch. The invention intends to provide a remedy, overall, here.

SUMMARY OF DISCLOSURE;

The invention addresses the technical problem of developing a motor vehicle door latch of the design described at the outset and of the form set out at the outset in such a way that an acoustically optimized solution is observed and in particular the "double clack noise" observed in the state of the art is omitted.

In order to solve this technical problem, a motor vehicle door latch of the type in question is characterized, within the context of the invention, in that the actuation lever for opening the locking mechanism is additionally designed to act on the pawl spring.

In detail, in this connection the actuation lever usually comprises a projection. In this case, the projection on the actuation lever can interact with the pawl spring. In this connection, the design is generally such that the projection in question, on the actuation lever, acts on the pawl spring only when the pawl is raised from the engagement thereof in the catch. As a result thereof, the actuation lever ensures, as usual by means of the tripping lever, that the pawl is raised from the engagement thereof in the catch. As soon as this is the case, the projection additionally provided on the actuation lever ensures that, subsequently thereto, the pawl spring is acted upon. That is to say that the pawl spring is raised from the pawl by means of the projection on the actuation lever.

In this manner, according to the invention merely a single "clack noise" is observed and occurs acoustically when opening the locking mechanism. This single clack noise arises in that the pawl is typically raised from the main ratchet thereof in abutment with the catch. The catch can now open in a spring-loaded manner. At the same time, any restoring forces built up by a peripheral rubber seal ensure that the locking mechanism opens more or less quickly.

Since, according to the invention, after the pawl has been raised from the engagement thereof in the catch, the projection of the actuation lever acts on the pawl spring and raises off the pawl, the pawl is at least briefly not (or no longer) acted on by a force, by means of the pawl spring, in the closing direction. As a result, said pawl can for example not (or no longer) smash back into the pre-ratchet recess of the catch that is moving in the opening direction, so that a further clack noise is avoided, according to the invention.

Since the actuation lever is typically returned to the starting position thereof, in a spring-loaded manner, immediately after the pawl has been raised, and specifically both during manual action and when the actuation lever is adjusted by a motor, the pawl spring can be brought into abutment on the pawl again, at the latest when the actuation lever is in the basic position, and can act on said pawl in the closing direction. That is to say that, within the context of the invention, the pawl is free from the pawl spring only briefly, specifically in total when there is a risk of the pawl smashing back in the direction of the pre-ratchet recess of the catch that is moved along the pawl, during the opening process. As soon as the catch is more or less completely open, the pawl is in any case in abutment on the outer periphery thereof, and remains in this position until the locking mechanism is closed again. This is ensured by the pawl spring which then once again acts on the pawl in the closing direction. This has substantial advantages.

Generally, the pawl spring is designed as a leg spring. In this connection, the pawl spring generally comprises two legs or spring legs. In this case, one of the legs of the pawl spring is designed as a pawl arm, and the other leg of the pawl spring is designed as a fastening arm. The fastening arm typically ensures that the pawl spring as a whole is fixed. For this purpose, the fastening arm is generally fixed to a housing of the motor vehicle door latch.

In contrast, the pawl arm of the leg spring is generally in abutment on the pawl, specifically at the outer periphery thereof, and ensures, overall, that the pawl is acted on in the closing direction. As soon as the projection on the actuation lever acts on the pawl spring, the projection ensures that the pawl arm of the pawl spring is raised from the abutment thereof on the outer periphery of the pawl.

For this purpose, the projection on the actuation lever is oriented so as to be substantially perpendicular with respect to an actuation lever plane. A projection of this kind can be formed on the actuation lever without problem during the manufacturing process thereof. Of course, it is also possible to form and implement the projection subsequently, for example by means of a screw inserted in the actuation lever functioning as a projection of this kind.

The actuation lever can be both an outer actuation lever and an inner actuation lever. In general, the actuation lever is designed as an outer actuation lever. Furthermore, the design is often such that the actuation lever or outer actuation lever acts on the locking mechanism by way of interposition of the above-mentioned tripping lever. Of course, the invention also covers embodiments in which the actuation lever and the tripping lever are formed integrally or as a common lever.

The actuation lever can be pivoted substantially in parallel with a locking mechanism plane. Ultimately, the design is typically such that the actuation lever overlaps the pawl spring at least in part. As a result, the projection that is oriented perpendicularly with respect to the actuation lever plane can interact with the pawl arm of the leg spring in a particularly simple and intuitive manner, and can raise the pawl arm from the abutment thereof on the outer periphery of the pawl, as has already been described.

As a result, a motor vehicle door latch is provided which is acoustically optimized, specifically at the same time as taking account of a structurally simple and cost-effective design. In this case, the solution according to the invention can be achieved and implemented both for an inner actuation lever chain and for an outer actuation lever chain, as well as for both lever chains. In addition to manual action on the locking mechanism, the invention can in principle also be used in connection with an electric lock, i.e. for the case in which the actuation lever is acted upon using an electric drive for opening the locking mechanism.

In all these cases, the actuation lever does not only ensure the locking mechanism is opened. Rather, the actuation lever assumes an additional dual function, in that it is designed for acting on the pawl spring. In fact, the actuation lever is equipped with the projection for this purpose, which projection interacts with the pawl spring. In this case, the projection of the actuation lever ensures that the pawl spring is raised from the pawl, specifically when the pawl itself has left the engagement position thereof in the catch. In this way, the "double clack noise" that is often observed in practice is effectively prevented and, according to the invention, no longer occurs. This has substantial advantages.

BRIEF DESCRIPTION OF DRAWINGS;

In the following, the invention will be explained in greater detail with reference to a drawing showing merely one exemplary embodiment. The single FIGURE schematically shows a motor vehicle door latch according to the invention, reduced to the central components.

The single figure shows a motor vehicle door latch. The motor vehicle door latch comprises a locking mechanism 1, 2 consisting of a catch 1 and a pawl 2. The catch 1 can be pivoted about a shaft 3. The pawl 2 can also be pivoted about a shaft 4. The two shafts 3, 4 are provided and defined by a bearing pin in each case that is anchored in an indicated latch case 5 and is intended for rotatable mounting.

The latch case 5 is closed off and covered from environmental influences by means of a latch cover (not shown). The fundamental structure also includes a tripping lever 6 which is mounted so as to be coaxial with respect to the pawl 2. The tripping lever 6 interacts with the pawl 2 via a projection 7. Furthermore, an actuation lever 8 is also formed which, in the exemplary embodiment and in a non-limiting manner, is designed as an outer actuation lever. The actuation lever 8 can be pivoted about a shaft 9 which is in turn provided and defined by a bearing pin fixed in the latch case 5.

DETAILED DESCRIPTION;

The catch 1 is provided with a catch spring which is not shown explicitly. The catch spring ensures that, after the pawl 2 has been raised, the catch 1 pivots about the shaft 3 thereof in the anticlockwise direction (indicated in the single figure by an arrow) and releases a locking bolt that was previously caught. In order to open the locking mechanism 1, 2, it is necessary to act on the actuation lever 8 such that said lever performs a clockwise movement (also indicated in the single figure) about the shaft 9 thereof. Since, in the exemplary embodiment, the actuation lever 8 is an outer actuation lever, said clockwise movement of the actuation lever 8 is initiated in that an outer door handle 10 works, in the corresponding manner, on the actuation lever 8 in question or the outer actuation lever, as is merely indicated in the single figure.

The clockwise movement of the actuation lever 8 or of the outer actuation lever results in a chamfer 11 on the actuation lever 8 coming into engagement with the tripping lever 6. As a result thereof, the tripping lever 6 is pivoted about the shaft 4 thereof in the anticlockwise direction indicated. Since the projection 7 of the tripping lever 6 can work on the pawl 2 or interacts therewith, the pawl 2 that is mounted so as to be coaxial with the tripping lever 6, about the common shaft 4, is also pivoted in the anticlockwise direction.

As a result, the pawl 2 is release from the indicated main ratchet on the catch 1. Thereupon, the catch 1 opens in a spring-loaded manner and moves, as described, in the anticlockwise direction about the shaft 3 thereof and, in the fully open state, releases a previously caught locking bolt (not explicitly shown). Since the motor vehicle door latch is attached in the inside of or on a motor vehicle door or hatch, while the locking bolt (not shown) is usually attached to the body, an associated motor vehicle door or hatch can subsequently be opened.

In the single figure, it can be seen that the chamfer 11 of the actuation lever 8 first acts on the tripping lever 6 and, as a result, raises the pawl 2 from the engagement thereof in the catch 1. The associated pivot movement of the actuation lever 8 in the clockwise direction about the shaft 9 results in a projection 12 that is additionally provided on the actuation lever 8 subsequently being able to interact with a pawl spring 13.

In the exemplary embodiment, the pawl spring 13 is designed as a leg spring. In fact, the pawl spring or leg spring 13 is made up of a pawl arm 13*a* as one leg and a fastening arm 13*b* as another leg. Both legs 13*a*, 13*b* are connected to a wound spring portion 13*c* which ensures that the pawl spring 13, as a whole, is fixed on the latch case 5. According to the exemplary embodiment, the two legs 13*a*, 13*b* of the leg spring, or the pawl arm 13*a* and the fastening arm 13*b* enclose, overall, an acute angle therebetween, which is in no way to be considered limiting.

In addition to the wound spring portion 13*c*, typically, and in addition or alternatively, the fastening arm 13*b* ensures that the leg spring or the pawl spring 13 is fixed on the latch case 5. In contrast, the pawl arm 13*a* is in abutment on an outer periphery of the pawl 2. Overall, the pawl spring 13 ensures action on the pawl 2 in the closing direction. The closing direction corresponds to a clockwise movement of the pawl 2 about the shaft 4 thereof, specifically such that the pawl 2 falls and also can fall either into the indicated main ratchet recess or into the additional pre-ratchet recess of the catch 1.

As already explained, the opening movement of the actuation lever 8 about the shaft 9 in the clockwise direction ensures that the chamfer 11 first acts on the tripping lever 6 and, as a result, the pawl 2 is raised from the engagement thereof in the catch 3. Subsequently, the projection 12 which is additionally provided and formed on the actuation lever 8 comes into engagement with the pawl arm 13*a* of the leg spring or pawl spring 13. A continued movement of the actuation lever 8 in the clockwise direction about the shaft 9 results in the projection 12 on the actuation lever 8 raising the pawl arm 13*a* of the leg spring or the pawl spring 13 from the abutment thereof on the outer periphery of the pawl 2. This prevents the pawl 2 from smashing back against the catch 1 in the event of the opening process initiated by the raising thereof from the catch 1.

In order to achieve this in detail, the projection 12 is oriented so as to be substantially perpendicular with respect to an actuation lever plane. The actuation lever plane is defined, in the example, by the areal extent of the actuation lever 8 and, in the present case, largely coincides with the drawing plane. Furthermore, the design is such that the actuation lever 8 is designed so as to be pivotable substantially in parallel with a locking mechanism plane. The locking mechanism plane spanned by the locking mechanism 1, 2 also coincides with the drawing plane or is oriented so as to be in parallel therewith.

Since the actuation lever 8 overlaps the pawl spring 13 at least in part, any malfunctions are prevented and the pawl spring 13 is at the same time arranged in a protected manner in the interior of the latch case 5. As soon as the actuation lever 8 has completed the opening process of the locking mechanism 1, 2 and for this purpose has moved, for example, against a stop (not sown in greater detail), the actuation lever 8 returns, generally in a spring-loaded manner, into the initial position thereof shown in the single figure. The outer door handle 10 being released by a user corresponds thereto.

As a result, the projection 12 also no longer acts on the pawl spring 13 and consequently the pawl arm 13*a* of the pawl spring 13 can return to be in abutment on the pawl 2. The catch 1 has now been pivoted into the open position thereof and has released the previously caught locking bolt. The pawl 2 is in abutment on the outer periphery of the catch 1, specifically in a region on either side of the two recesses indicated (main ratchet recess and pre-ratchet recess). Proceeding from this position, the locking mechanism 1, 2 can be transferred again into the closed and, in the figure, functional, position by means of the locking bolt that is inserted into the catch 1.

The invention claimed is:

1. A motor vehicle door latch comprising:

a locking mechanism having a catch and a pawl;

a pawl spring for acting on the pawl in a closing direction pressing the pawl into engagement with the catch;

an actuation lever for opening the locking mechanism, the actuation lever being configured for acting on the pawl spring and having a first projection that interacts with the pawl spring, wherein the actuation lever has a second projection configured to cause rotation of the pawl away from engagement with the catch as the actuation lever rotates, wherein the rotation of the actuation lever further directly presses the first projection onto the pawl spring causing the pawl spring to be raised from the pawl; and a tripping lever that rotates about a shaft, wherein the second projection of the actuation lever acts against the tripping lever, and the tripping lever acts against the pawl to enable rotation of the catch to an opening position.

2. The motor vehicle door latch according to claim 1, wherein the pawl spring is a leg spring.

3. The motor vehicle door latch according to claim 2, wherein one leg of the leg spring is a pawl arm and another leg of the leg spring is a fastening arm.

4. The motor vehicle door latch according to claim 3, wherein the pawl arm and the fastening arm define an acute angle therebetween.

5. The motor vehicle door latch according to claim 3, wherein the pawl arm is configured to engage an outer periphery of the pawl.

6. The motor vehicle door latch according to claim 1, wherein the first projection is oriented to be perpendicular with respect to an actuation lever plane.

7. The motor vehicle door latch according to claim 1, wherein the actuation lever is an outer actuation lever or an inner actuation lever.

8. The motor vehicle door latch according to claim 1, wherein the actuation lever is pivotable in a plane that is parallel with a locking mechanism plane in which the locking mechanism is arranged.

9. The motor vehicle door latch according to claim 1, wherein the actuation lever overlaps the pawl spring at least in part.

10. The motor vehicle door latch according to claim 1, wherein the tripping lever is mounted to be coaxial relative to the pawl.

11. The motor vehicle door latch according to claim 1 further comprising an outer door handle configured to initiate movement of the actuation lever.

12. The motor vehicle door latch according to claim 1, wherein the tripping lever has a projection that engages the pawl.

13. The motor vehicle door latch according to claim 1, wherein the first projection that engages the pawl spring extends perpendicular relative to a plane of the actuation lever.

* * * * *